US007517260B2

(12) United States Patent
Luzzi

(10) Patent No.: US 7,517,260 B2
(45) Date of Patent: Apr. 14, 2009

(54) MULTIPLE BORE TERMINATION SYSTEM

(75) Inventor: Glenn J. Luzzi, Mt. Bethel, PA (US)

(73) Assignee: Richards Manufacturing Company, Irvington, NJ (US)

( * ) Notice: Subject to any disclaimer, the term of this patent is extended or adjusted under 35 U.S.C. 154(b) by 0 days.

(21) Appl. No.: 12/127,488

(22) Filed: May 27, 2008

(65) Prior Publication Data

US 2008/0227342 A1 Sep. 18, 2008

Related U.S. Application Data

(63) Continuation of application No. 11/394,858, filed on Mar. 30, 2006, now Pat. No. 7,381,103.

(60) Provisional application No. 60/686,081, filed on May 31, 2005, provisional application No. 60/667,387, filed on Apr. 1, 2005.

(51) Int. Cl.
*H01R 4/30* (2006.01)

(52) U.S. Cl. ..... 439/801

(58) Field of Classification Search ..... 439/181–187, 439/921, 813, 278, 279
See application file for complete search history.

(56) References Cited

U.S. PATENT DOCUMENTS 3,883,208 A 5/1975 Sankev
4,210,381 A * 7/1980 Borgstrom ..... 439/161
4,722,694 A 2/1988 Makai et al.
4,857,021 A 8/1989 Boliver et al.
5,114,357 A 5/1992 Luzzi
5,421,750 A 6/1995 Crotty
6,416,338 B1 * 7/2002 Berlovan ..... 439/187
6,491,548 B2 * 12/2002 Stepniak et al. ..... 439/620.28
6,520,795 B1 * 2/2003 Jazowski ..... 439/475
6,796,820 B2 9/2004 Jazowski et al.
6,843,685 B1 * 1/2005 Borgstrom et al. ..... 439/606
6,991,484 B2 1/2006 Luzzi
7,234,980 B2 * 6/2007 Jazowski et al. ..... 439/801

* cited by examiner

*Primary Examiner*—Chandrika Prasad
(74) *Attorney, Agent, or Firm*—Stroock & Stroock & Lavan, LLP

(57) ABSTRACT

A cable termination housing for terminating a cable to one or more devices includes a bore for receiving a device mating portion, a component portion integrally formed within the housing, the component portion having a fastener that is slidable between a retracted position wherein fastener does not extend into the lug aperture of the cable assembly and an extended position wherein the fastener extends into the lug aperture. Preferably, the fastener is rotatable while in its extended position so as to couple with the device mating portion.

22 Claims, 20 Drawing Sheets

PRIOR ART

MULTIPLE BORE TERMINATION SYSTEM

CROSS-REFERENCE TO RELATED APPLICATIONS

This application is a continuation of copending U.S. patent application Ser. No. 11/394,858 filed on Mar. 30, 2006 now U.S. Pat. No. 7,381,103 entitled "MULTIPLE BORE TERMINATION SYSTEM," which claims the benefit of U.S. Provisional Application Ser. No. 60/667,387 filed on Apr. 1, 2005, and U.S. Provisional Application Ser. No. 60/686,081 filed on May 31, 2005, both of which are entitled "MULTIPLE BORE TERMINATION SYSTEM", all three of which are hereby incorporated in their entirety by reference.

TECHNICAL FIELD OF THE INVENTION

The present invention relates to a multiple bore termination system that may be used for terminating electrical cables. More particularly, the present invention relates to a multiple bore termination system for connecting an electrical cable to an apparatus, such as a transformer or high voltage switch, and is ideally suited for use with electrical cables and/or electrical equipment.

BACKGROUND OF THE INVENTION

Existing cable termination systems for connecting a cable to an apparatus, two cables or two feeder cables with a tap are known in the art. A termination system typically includes, at a minimum, a cable or wire preferably having a coupling device, such as a metallic lug, an apparatus preferably having a terminal for connecting to the system, a stud (i.e., a pin type or threaded device inserted into the aperture of the metallic lug), mating devices (i.e., devices that couple to the stud to maintain the stud within the aperture of the metallic lug) and a housing (i.e., a device that encloses the cable/apparatus connection). According to the use of the termination system, it can further comprise a component and the like for making the system suitable for the specified use. For example, the component can be a specific plug, or it can be connected to another device, examples of which include a termination system, a transformer, switch and/or a switchgear.

According to a commonly known termination system, a metallic lug containing an aperture is attached to an end of a cable, which is then inserted into a bore entrance of a housing such that the end of the metallic lug containing the aperture enters the housing first. Typically, the aperture in the lug can be one of two "primary" varieties. The industry standard lug, which is also the oldest lug, contains a ⅝ in. through-aperture which is slightly large enough to allow passage of a threaded stud comprising ⅝ inch, at 11 threads per inch (⅝"-11), which is often used with an elbow and epoxy insulating plug, reducing tap well, connecting plug or a 200 A dead break reducing tap plug. With the development of the "operable" products, which often use a 600 ampere-to-200 ampere load break reducing tap plug, it became necessary to marry the load break reducer to the 600 amp elbow. This was accomplished by increasing the standard lug aperture to a 15/16"-9 threaded aperture, which was the smallest thread size that would still allow passage of a ⅝"-11 threaded member. The prepared cable/lug assembly can be inserted into the cable entrance of the elbow, and the load break reducing tap plug could then be threaded into the lug. However, the threading process can create significant field problems.

Typically, a first mating device having a component, for example, a loadbreak reducing tap plug, or a dead break reducing tap plug having a deadbreak interface, etc is inserted into a second bore entrance of the housing. According to a method known in the art, the first mating device can be suitable for use with a device that can be electrically connected to the cable via the second mating device. The connection may incorporate additional components and may be performed in alternative configurations utilizing a variety of methods that are known in the art. The component of the first mating device can either include a stud, which is inserted into the aperture of the metallic lug or a cavity for receiving such a stud.

A second mating device, for example, a terminal affixed to the apparatus (e.g., bushing, transformer, high voltage switch, etc.) is then inserted into a third bore entrance. Similar to the first mating device, the second mating device can also include a stud or a cavity. When the terminal system is assembled, a conductive physical connection can be created between the metallic lug and the first and second mating devices.

If the component of the first mating device comprises a stud and the second mating device comprises a cavity, the stud can be inserted through the aperture of the metallic lug and into the cavity of the second mating device. The stud and metallic lug can engage either via complementing threaded portions or by sliding the bolt into the aperture of the metallic lug, which can result in the component of the first mating device and metallic lug to be electrically connected preferably via the face and sleeve of the lug. If the mating device is a load break tap plug, such as the Load Reducing Tap Plug (LRTP), the aperture of the lug can be threaded, thereby permitting a threading engagement between the lug and the load break reducing tap plug, which is performed initially with everything de-energized. Or, if the mating device is a Reducing Tap Plug (RTP), Reducing Tap Well (RTW) or Connecting Plug (CP), the stud can be slid through the aperture of the metallic lug into the cavity of the mating device to create an electrical connection. The respective first mating device can subsequently threadingly engage the second mating device.

Alternatively, if the component of the first mating device comprises a cavity and the second mating device comprises a stud, the assembly comprising the housing and the first mating device must be properly aligned and placed over the second mating device. However, because the assembly of the housing and the first mating device lacks a stud holding the metallic lug, the housing and the first mating device together, each element must be properly aligned and balanced to ensure proper insertion of the stud through the aperture of the metallic lug and into the cavity of the component of the first mating device. Alternatively, in accordance with the T OP II™ manufactured by Cooper Power Systems, the first mating device can include a threaded member having a threaded exterior as well as a threaded cavity. This threaded member can be threaded into the aperture of the metallic lug. Thereafter, the threaded stud of the second mating device can be inserted into and threadingly engaged with the threaded member.

Typically, the installer of the termination system must manually maneuver a bolt through the component of the first mating device, through the aperture of the metallic lug and into the cavity of the second mating device, and tighten the bolt using an instrument several feet long until the three elements are electrically connected. It is preferable for the instrument to be several feet long to maintain a sufficient distance between the installer and the termination system in order to protect the installer from potential harm. The bolt must be inserted in the proper direction and angle to properly hold the assembly in place, which can become a difficult task at a several feet distance. However, if the first mating device is an LRTP or T OP II™, it is already assembled into the lug aperture, and if the first mating device is an RTW, RTP, CP (Connecting Plug) or an insulating plug, such as a BIP, this tightening procedure would not be performed using a hot stick or a long instrument.

One potential problem that may arise is that if a sleeve of an LRTP or T OP II™ is threaded, it may cross thread with the threading in the metallic lug, thereby failing to create a secure and stable electrical connection. The installer may feel resistance from the cross threading and can assume that the resistance indicates a complete, secure connection. This problem is aggravated by the fact that the installer is performing the task blind, without being able to see the threading. Moreover, the lug, and therefore the thread in the lug, is of rather soft materials (aluminum and copper) and is easily cross-threaded. Additionally, proper alignment of the threads can be very difficult because of the weight of the cable. On top of the fact that the operation cannot be viewed and the weight of the cable, the lineman must force the load break reducing tap plug forward to overcome the rubber interference while trying to engage the thread, creating potential problems. Furthermore, the total thread engagement of the prior art is typically only a maximum of ½ inch, the width of the lug, rather than a more accepted engagement of 1½ times the diameter of the thread. Because of the very short thread length there is no room for a lead-in on the male portion to allow proper alignment.

Alternatively, if a product such as a connecting plug, reducing tap well, reducing tap plug, or insulating plug, which do not thread into the metallic lug is used, the installer must force the mating device into the elbow while simultaneously pushing the elbow onto the bushing or Connecting Plug, potentially creating difficulties during installation.

Another potential problem with the commonly known connectors and methods of connecting an electrical cable to an apparatus is the difficulty in connecting the cable and apparatus via separate components, for example, reducing tap plugs, connecting plugs, reducing tap wells, and the like. Typically, the components are independent from the connector housing and must be inserted into the second bore entrance and is connected to the housing by friction fit. According to whether or not the first mating device comprises a stud, different drawbacks are present.

Some other prior art termination systems utilize a connector housing and a separately molded mating device comprising a component having a threaded stud, such as the LRTP device shown in FIG. 2. The separately molded component includes a component guide portion for guiding and aligning the component into the aperture of the metallic lug, as well as a threaded portion for threadingly engaging the metallic lug, thereby pulling the separately molded mating device further into the second bore of the housing and holding it in position. More specifically, a cable assembly is inserted into the connector housing. Then, while holding the cable assembly in place, the separately molded component is inserted into a bore such that the component guide portion passes through the aperture of the metallic lug of the cable assembly, then the separately molded component is threadingly engaged with the metallic lug. Therefore, the three separate elements, the cable assembly, the housing and the separately molded component, which can be cumbersome and heavy, must be properly positioned and held in that position during this process.

The separately molded component further comprises two threading elements that engage each other, which pull the housing portion further into the second bore of the termination system housing when the threaded portion is prevented from threading any further. An embedded stud within the component then pushes the guide portion, which detaches and is removed. Therefore, in order for this separately molded mating device to be properly inserted within the housing, elements such as the guide and the threaded portion are needed, which renders the device complex with multiple parts that also can increase the cost. Additionally, because the three separate elements must be simultaneously held in position, the process can be cumbersome and difficult. Furthermore, because the separately molded component threadingly engages the metallic lug, the metallic lug necessarily has a threaded aperture, thereby increasing the diameter of the aperture and hence decreasing the amount of metal in the metallic lug surrounding the bolt. The thread is typically large, about 15/16"-9, thereby eliminating a significant section of the current-carrying area between the lug and the mating diameter which is about 1¼ inches. In addition, because the mating device is a separately molded component, it suffers from some of the same problems of the other prior art devices discussed above.

In order to provide a better understanding of the state of the art related to the field of electrical termination systems, discussed below are several references. Although these references serve to provide a perspective as to the state of the related art, they fail to disclose the novel aspects of the present invention as discussed in detail herein and claimed hereafter.

For example, U.S. Pat. No. 5,114,357 to Luzzi ("Luzzi") discloses a termination system for connecting a high voltage electrical cable to a high voltage electrical terminal. The housing of Luzzi can be generally L-shaped, having a cable receiving leg and a terminal receiving leg, wherein the terminal receiving leg has two bores. A bolt is captivated within the terminal receiving leg, and is operated by an external tool to join or separate a cable inserted in the cable receiving leg to a terminal inserted in a first bore of the terminal receiving leg. Luzzi discloses that the bolt can be within a second bore of the terminal receiving leg and include a cylindrical plug of hard insulating material to prevent the electricity from being conducted outside the connector through the second bore. The plug can be removed prior to tightening or loosening the bolt, and reinserted afterward in order to insulate the connector. Luzzi, however, does not disclose how to connect the termination system to a second device via the second bore, but is directed to an elbow having an insulating plug at the second bore. Furthermore, Luzzi does not provide for safety testing or grounding.

U.S. Pat. No. 3,883,208 to Sankey et al. ("Sankey") discloses a visible break tee connector for electrically connecting a high voltage cable to a terminal, comprising a T-shaped housing, a connecting member and a contact assembly. When installed, the connecting member is electrically connected to the terminal and the high voltage cable. The contact assembly is in electrical contact with the connecting member, providing a ground contact on disconnection. During disconnection, the housing, the connecting member and the contact assembly can be disconnected from the terminal without disconnecting the cable from the connecting member. Sankey, however, does not include a movable piston and therefore does not have loadbreak capabilities for safety testing or a fault close capability for safe grounding of the system. Accordingly, the elbow or cap connected to the opposite side of the first mating device cannot be removed when the cable is live without potentially causing an explosion in the termination system. This can be especially problematic because the termination system can provide a perception that the device does have loadbreak and fault close capabilities. Furthermore, if a cap was the mating part and was successfully removed, there is no safe way to ground the assembly without load break components inside the LRTP.

Sankey also requires unconventional products. For example, Sankey discloses the use of a specialized lug having a groove to house a conductive ring to electrically connect the cable to the connecting member. This also can hinder current flow between the cable and the connecting member, and therefore the terminal. Furthermore, the contact assembly is directly inserted into the housing through a passage, which produces a risk of contaminating the inside bore of the device which can lead to product failure.

Additionally, the prior art devices, because they require separated molded components, can result in an undesirably long stack height after assembly because of the interfaces of each element, such as the interface of the elbow in combination with the interface of the separately molded component.

In light of the prior art discussed herein, it is desirable to provide a simple, safe, easy to install, cable termination system having a reduced stack height suitable for use with devices known in the art.

SUMMARY OF THE INVENTION

The present invention relates to a novel cable termination system for terminating a cable to an apparatus, such as a transformer or high voltage switch, within a housing. The present invention is a simple, economical system that terminates a cable that is connected to a coupling device, such as a metallic lug, to an apparatus. The present invention is preferably directed to a system that may terminate a cable to an apparatus, with a means of testing and grounding the connection or connecting two "through-cables" and a third cable tap, according to methods known in the art, require the use of a separate component or connecting plug, such as but not limited to, a loadbreak reducing tap plug, a dead break reducing tap plug, a reducing tap well, insulating plug and a connecting plug.

The present invention provides a system that is easier to install, less expensive, includes fewer components, reduces the overall stack height of the completed connection, and substantially eliminates discarded components, certain installation tools, and installation error. The invention preferably also eliminates the extra interface between the different elements, thereby substantially eliminating the associated contamination area and the requirement of an inherent reduced electrical stress of an interface and thus is more reliable than the cable termination systems known in the art. Whereas the systems commonly known in the art utilize a separate component for connecting the termination system to a secondary device, an embodiment of the present invention provides a simplified system eliminating the need for a separate component and the risk of improperly connecting the system as well as the risk of contaminating the contact. The present invention can comprise an elbow housing with a built-in and/or integrally molded component and the like having a stud, preferably a threaded bolt, therefore eliminating the step of combining the first mating device and the elbow, and providing a properly aligned bolt for proper insertion into the aperture of the second mating device, for example, a transformer, switch bushing, etc. of the termination system.

Alternatively, an embodiment of the present invention can comprise a stud receiving cavity rather than a stud itself, for use with terminals having studs attached thereto. For example, an apparatus may comprise a first mating device component having a receiving cavity for receiving a stud of a second mating device, wherein the stud enters the receiving cavity through the aperture of the metallic lug. Preferably, the receiving cavity is connected to a rotating member that can rotate the receiving cavity around the terminal stud, thereby tightening the connection of the termination system.

The present invention can preferably overcome the significantly high risk of improper installation of termination systems onto a terminal, as well as the cost of separately molding a component, excessive stack height of the separate components and the associated reduction in dielectric strength of two separate components.

Thus, it is an object of the present invention to provide a method and apparatus for terminating a cable to an apparatus that eliminates the utilization of a separate component for connecting to a second device.

Additionally, it is an object of the present invention to provide a method and apparatus for terminating a cable to an apparatus that eliminates the use of a lug having a 15/16 inch threaded aperture.

Furthermore, it is an object of the present invention to provide a method and apparatus for terminating a cable to an apparatus that significantly eliminates the risk of the cable separating from the apparatus during installation and/or during subsequent visible break operations performed on the end of the hot stick.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present invention. The following presents a detailed description of a preferred embodiment of the present invention.

Figure 1:
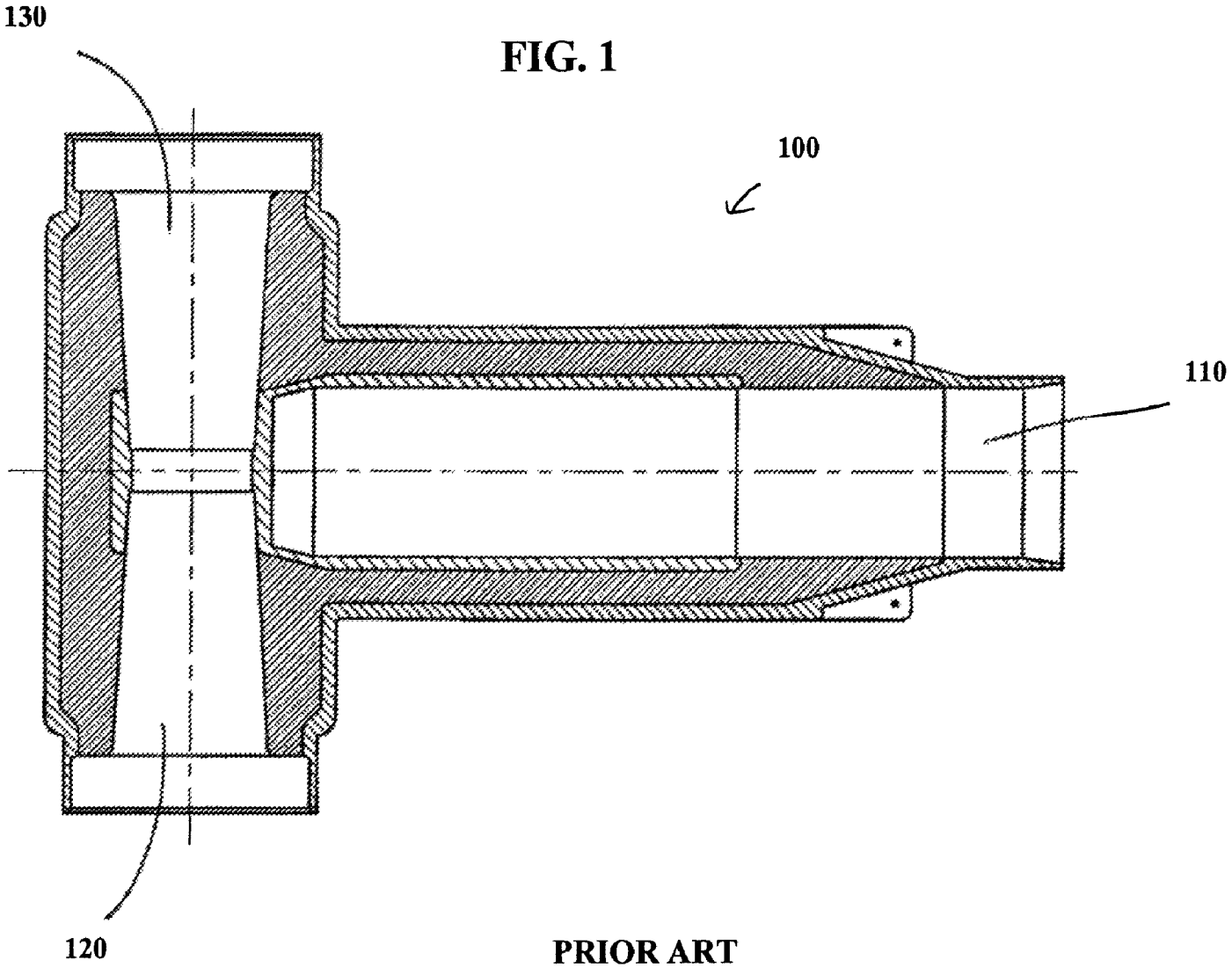
FIG. 1 PRIOR ART
FIG. 1 is a cross sectional view of an elbow housing of a prior art termination system.
Figure 2:
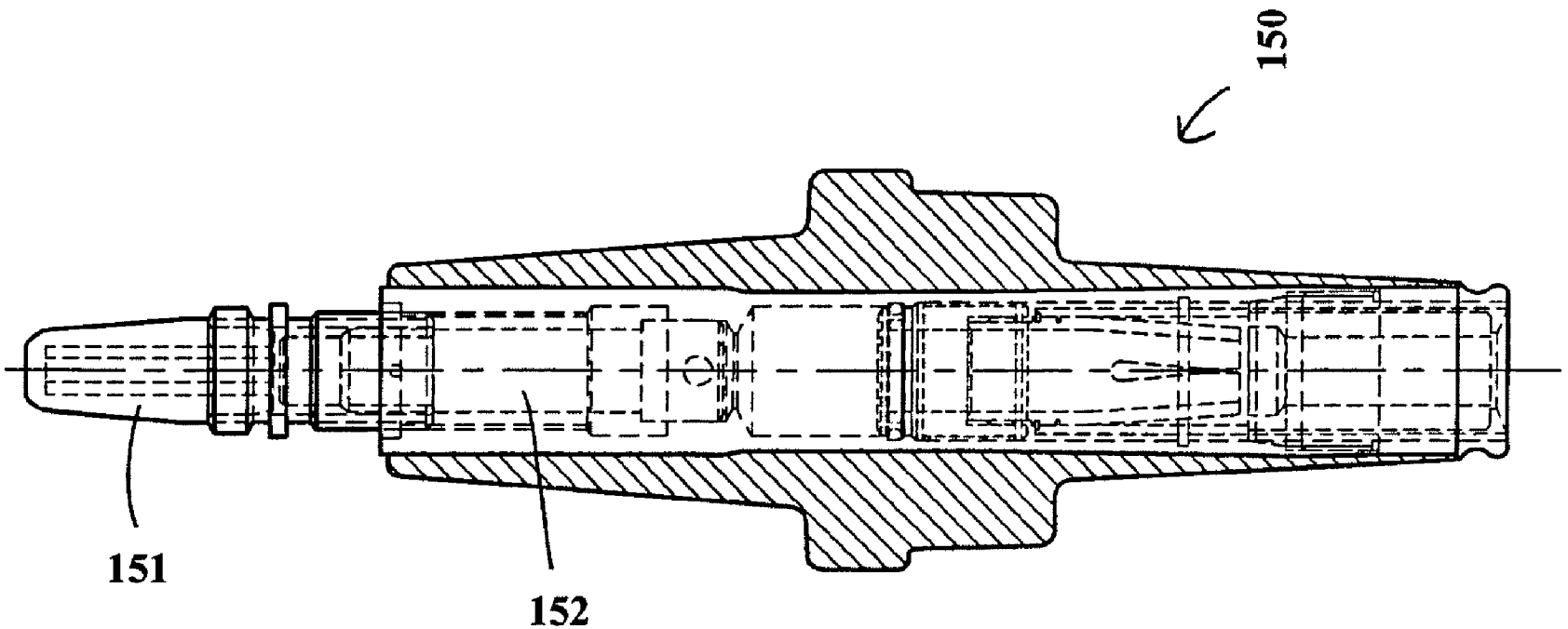
FIG. 2 is a cross-sectional view of a prior art loadbreak reducing tap component.

Referring initially to FIG. 1, shown is a typical elbow housing for a prior art elbow housing termination system. As depicted, housing 100 comprises a first bore 110, which is perpendicular to a second bore 120 and a third bore 130. Typically, a cable is inserted in first bore 110, a first mating device for an apparatus is inserted in second bore 120 and a separate component is inserted in third bore 130, all of which are held together by a threaded bolt (not shown). FIG. 2 shows a prior art component portion 150 having a component guide portion 151 for guiding and aligning the component comprising a stud 152 therein into the aperture of the metallic lug.

Referring to FIGS. 3A-4B, component portion 200 of an elbow 101 in accordance with an embodiment of the invention can comprise a fastener 210, that is preferably rotatable, having a male threaded section 211 suitable for mating with an apparatus bushing having a female threaded section. The fastener 210 can also comprise a rotating portion 212 that can preferably provide a means for rotating fastener 210. According to a preferred embodiment of the invention, rotating portion 212 can comprise an aperture 215, more preferably, an internal hex 215, thereby permitting fastener 210 to be rotated by a male hex tool inserted through third bore 131 into rotating portion 212 of fastener 210.

Figure 3A:
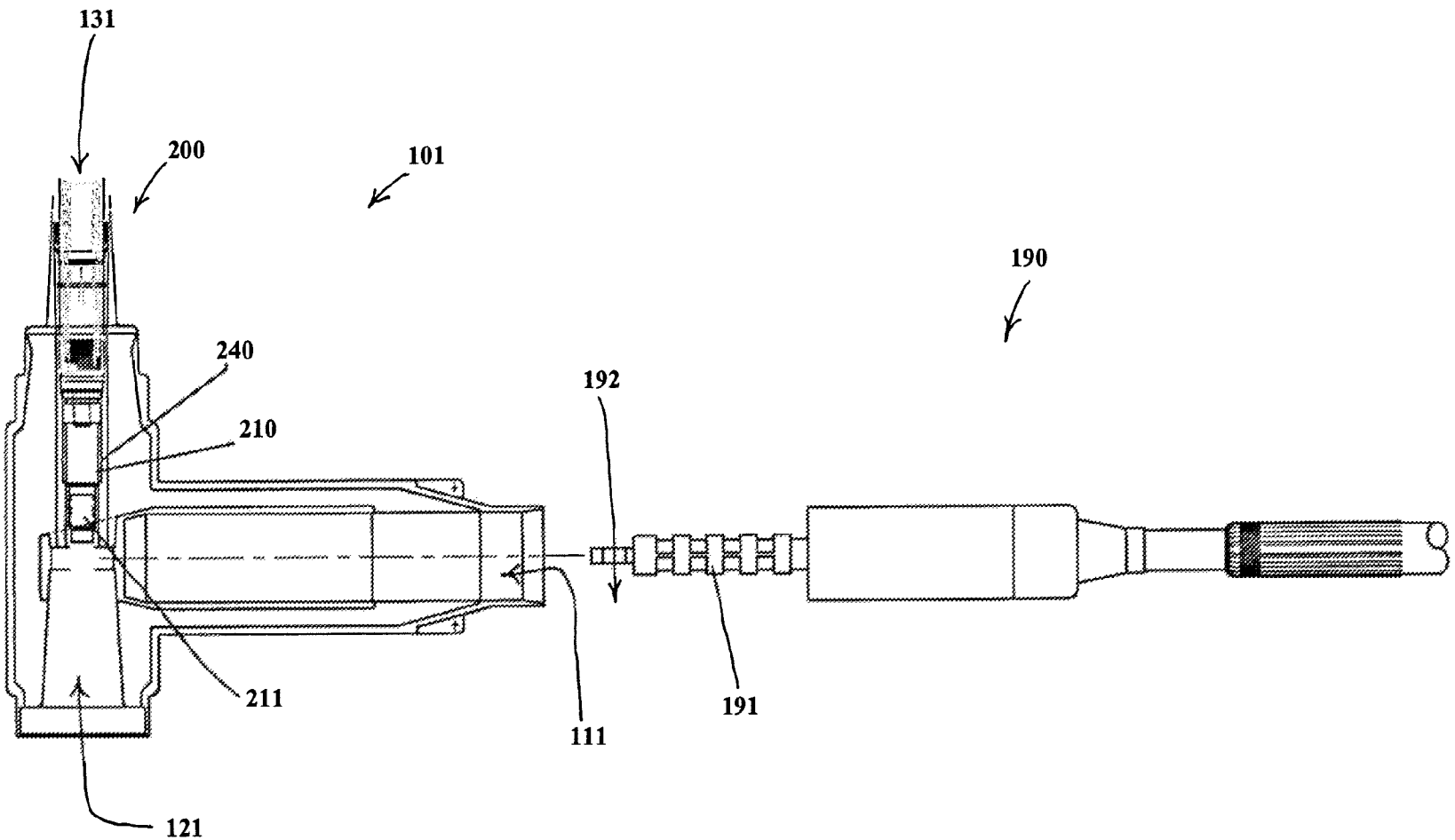
FIG. 3A is a cross-sectional view of an elbow housing incorporating a termination system in accordance with an embodiment of the present invention.
Figure 3B:
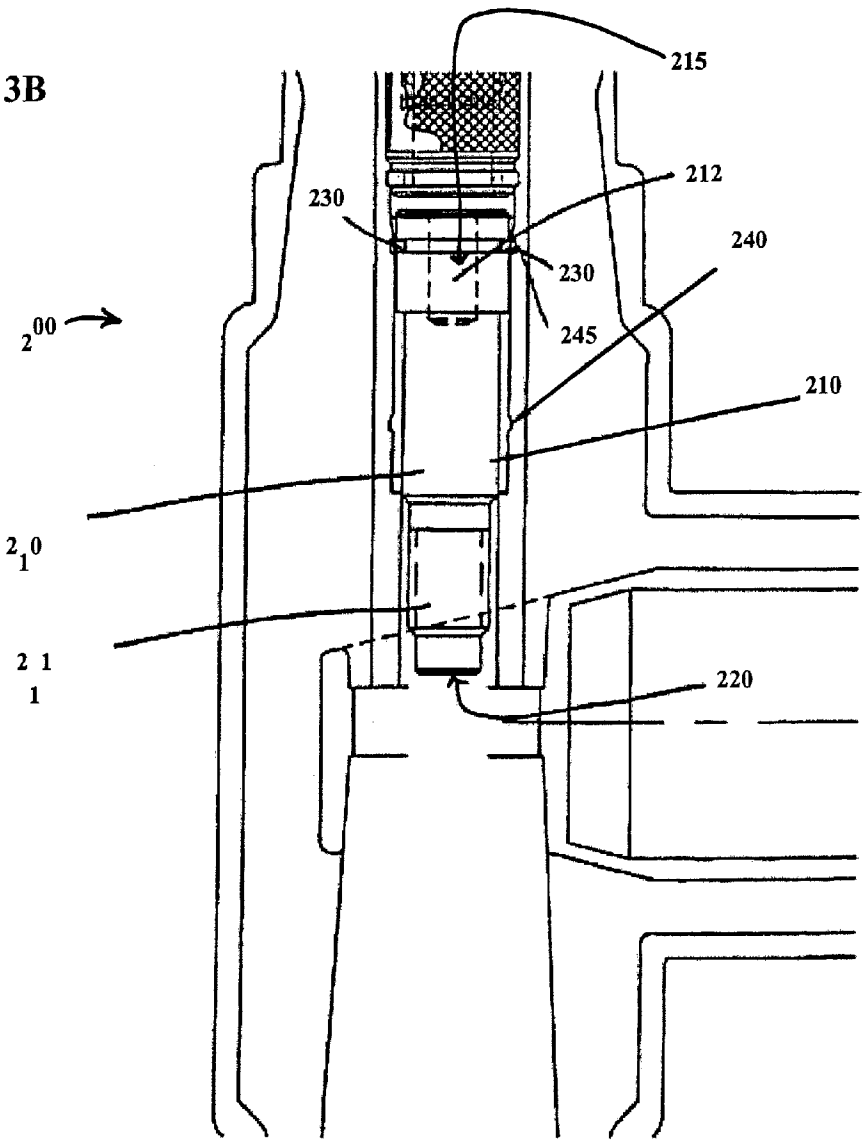
FIG. 3B is a magnified view of area A of FIG. 3A.

Prior to installation, it is preferable for fastener 210 to be in a retracted position, as shown in FIGS. 3A and 3B, which can facilitate the insertion of a prepared cable and lug assembly 190 into a first bore 111 of elbow 101. Preferably, a retaining assembly is present to maintain fastener 210 in the retracted and extended positions. In a preferred embodiment, the retaining assembly comprises a snap ring, etc. In an alternate embodiment, the retaining assembly can comprise a single element such as a pellet, more preferably a nylon pellet, which is capable of providing drag or friction to maintain fastener 210 in the retracted and extended positions. When cable and lug assembly 190 is inserted into first bore 111, an aperture 192 in lug 191 can preferably be aligned with male threaded section 211.

Figure 4A:
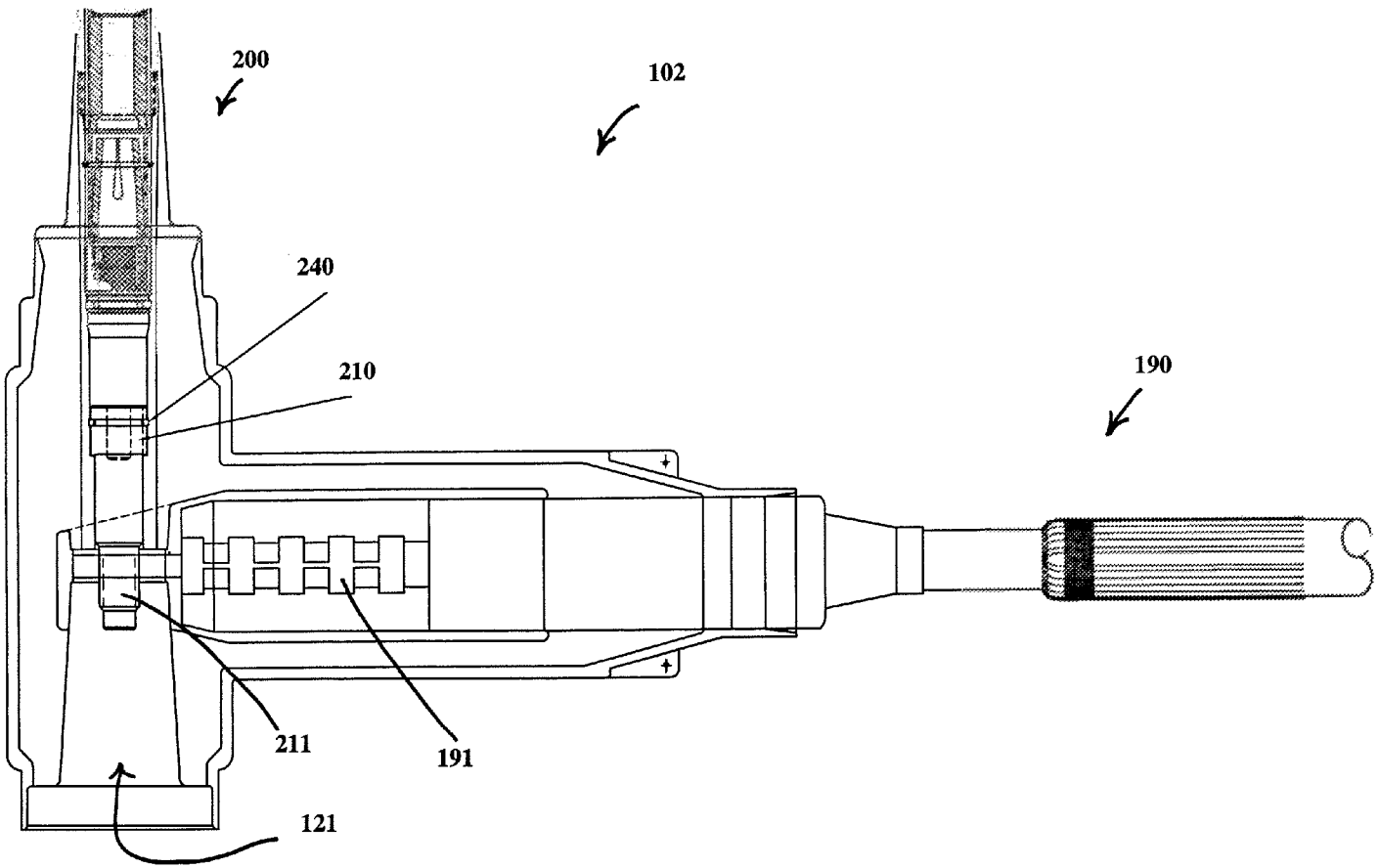
FIG. 4A is a cross-sectional view of an elbow housing incorporating a termination system in accordance with an embodiment of the present invention.
Figure 4B:
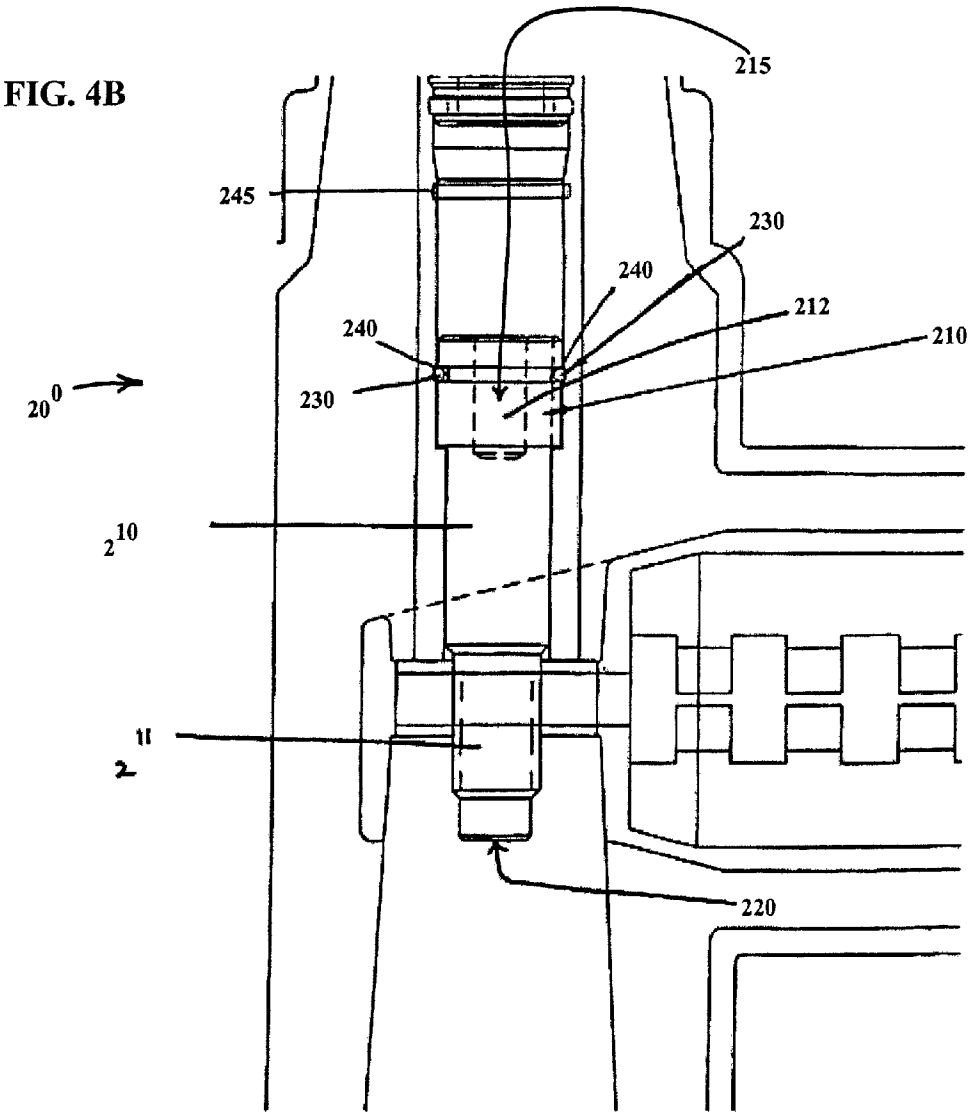
FIG. 4B is a magnified view of area B of FIG. 4A.

During installation, after cable and lug assembly 190 is properly inserted and aligned, a hex tool can be inserted into third bore 131 until the hex tip engages rotating portion 212 of fastener 210. The hex tool can be used to push fastener 210, until leading edge 220 passes through aperture 192 of lug to a sufficient distance into an extended position as shown in FIGS. 4A and 4B. An embodiment of the elbow assembly 102 comprising elbow 101 and cable and lug assembly 190 can be placed on a terminal comprising a component, such as a bushing, via second bore 121, aligning the female mating portion of the bushing with male threaded section 211. The hex tool can be used to rotate fastener 210, thereby tightening male threaded section 211 into the female mating portion of the bushing. Preferably, fastener 210 is free to rotate within component portion 200, and therefore, can be rotated without affecting the position of component portion 200 with respect to the bushing. Most preferably, in order to significantly reduce potential error during installation, fastener 210 cannot be rotated until fastener 210 is in the extended position. An example of an anti-rotation element is described below.

Fastener 210 most preferably comprises a locking element that maintains fastener 210 in the extended position once a sufficient distance is reached. In accordance with a preferred embodiment of the invention, the locking element can also maintain fastener 210 in the retracted position prior to initiation of fastener 210 into the extended position. For example, in accordance with an embodiment of the invention, fastener 210 can comprise a snap ring 230, which can extend into a first groove 245 when fastener 210 is in the retracted position, retract when in between the retracted position and the extended position, and then extends into a second groove 240 when aligned therewith, as shown in FIG. 4B, into the extended position. Alternatively, in accordance with an embodiment lacking first groove 245, locking element 230 can remain retracted when fastener 210 is in the retracted position, and can extend into second groove 240 when fastener 210 is in the extended position.

According to one embodiment, the locking element preferably releasably maintains fastener 210 in the retracted position, but preferably permanently maintains fastener 210 in the extended position, thereby preventing cable and lug assembly 190 from inadvertently falling out of elbow 101 after assembly thereof. In addition, when elbow assembly 102, 104 is removed from the bushing, the tool, such as a hex tool, can be inserted into third bore 131 and used to rotate fastener 210 so as to loosen the connection. Because locking element 230 preferably holds fastener 210 to elbow 101, the action of loosening fastener 210 can force the entire assembly to be backed off the bushing. Cable and lug assembly 190 can remain locked in elbow 101 and fastener 210 can remain in the extended position, thereby maintaining their respective relationship.

FIGS. 5A-6B illustrate embodiments of the invention having component portion 300 comprising a fastener 310, which is preferably rotatable and comprises a female threaded section 311. These embodiments are particularly suitable for use with apparatus terminals having a component, for example, a bushing, having a male threaded section, such as a threaded stud, projecting therefrom. Elbow assembly 104 can be placed over the terminal component comprising the threaded stud until the threaded stud is inserted through the aperture of the metallic lug and engages female threaded section 311. Similar to the embodiment shown in FIGS. 3A-4B, fastener 310 can comprise a rotating portion 312 that can provide a means for rotating fastener 310, thereby permitting fastener 310 to be rotated once fastener 310 is released from the retracted position.

Figure 5A:
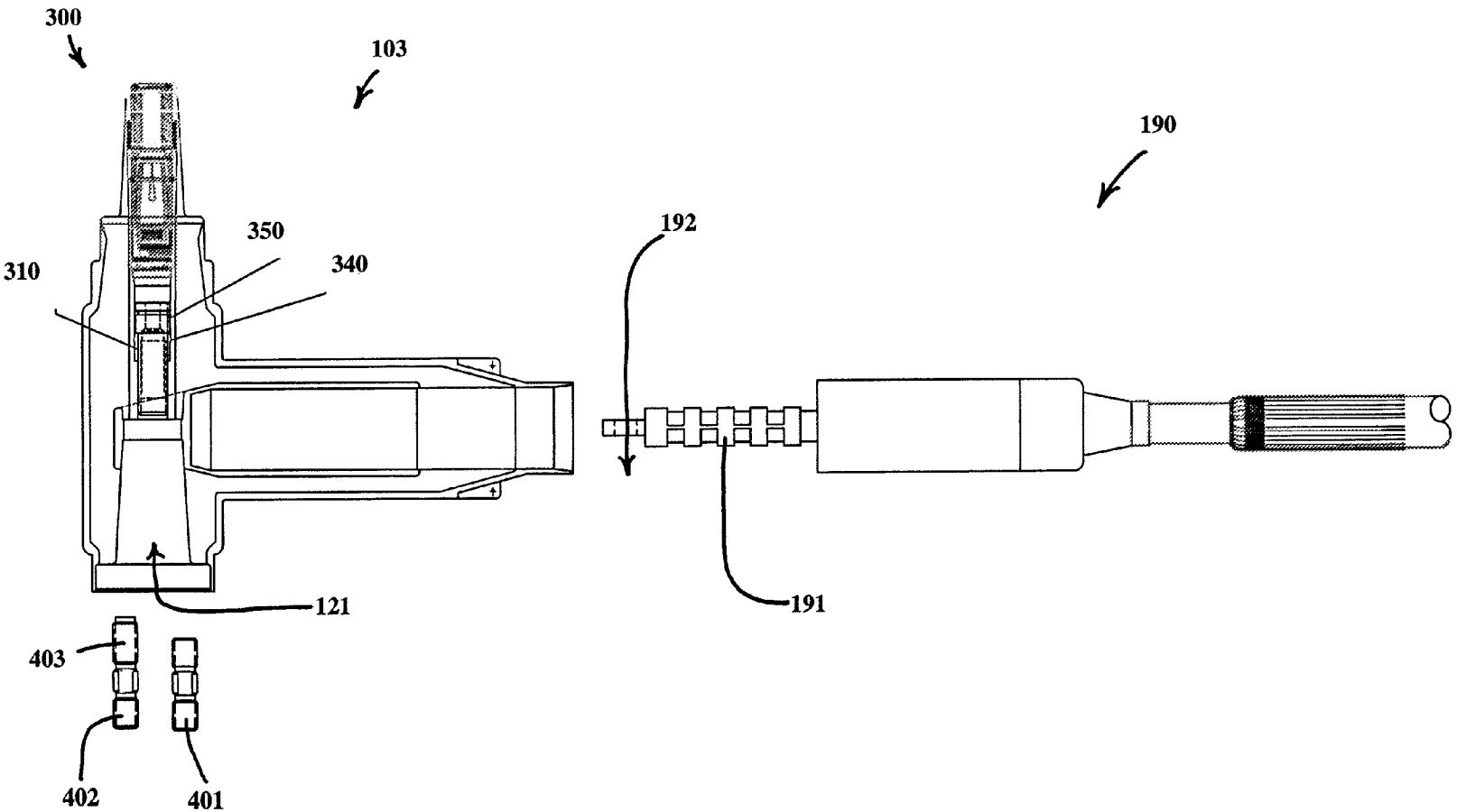
FIG. 5A is a cross-sectional view of an elbow housing incorporating a termination system in accordance with an embodiment of the present invention.
Figure 5B:
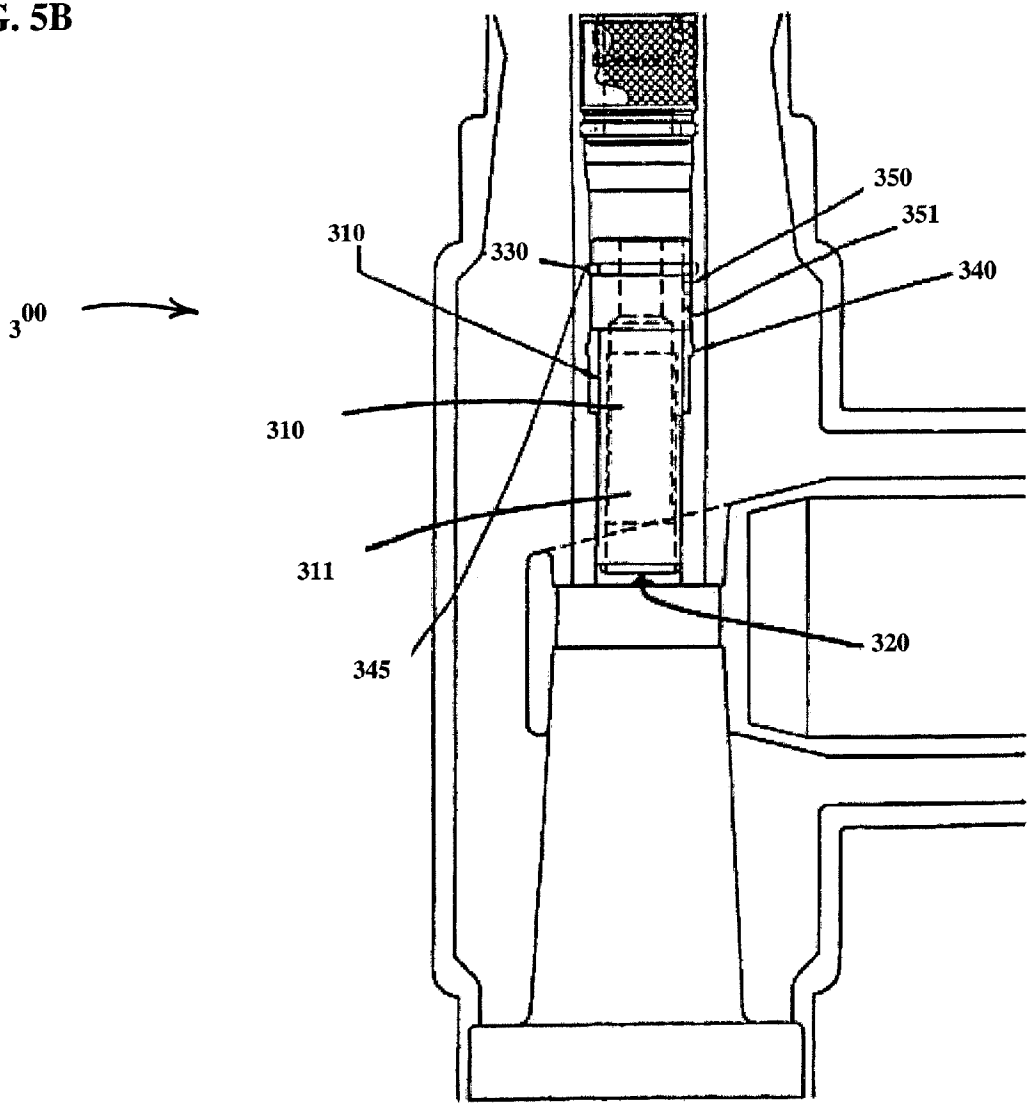
FIG. 5B is a magnified view of area C of FIG. 5A.
Figure 6A:
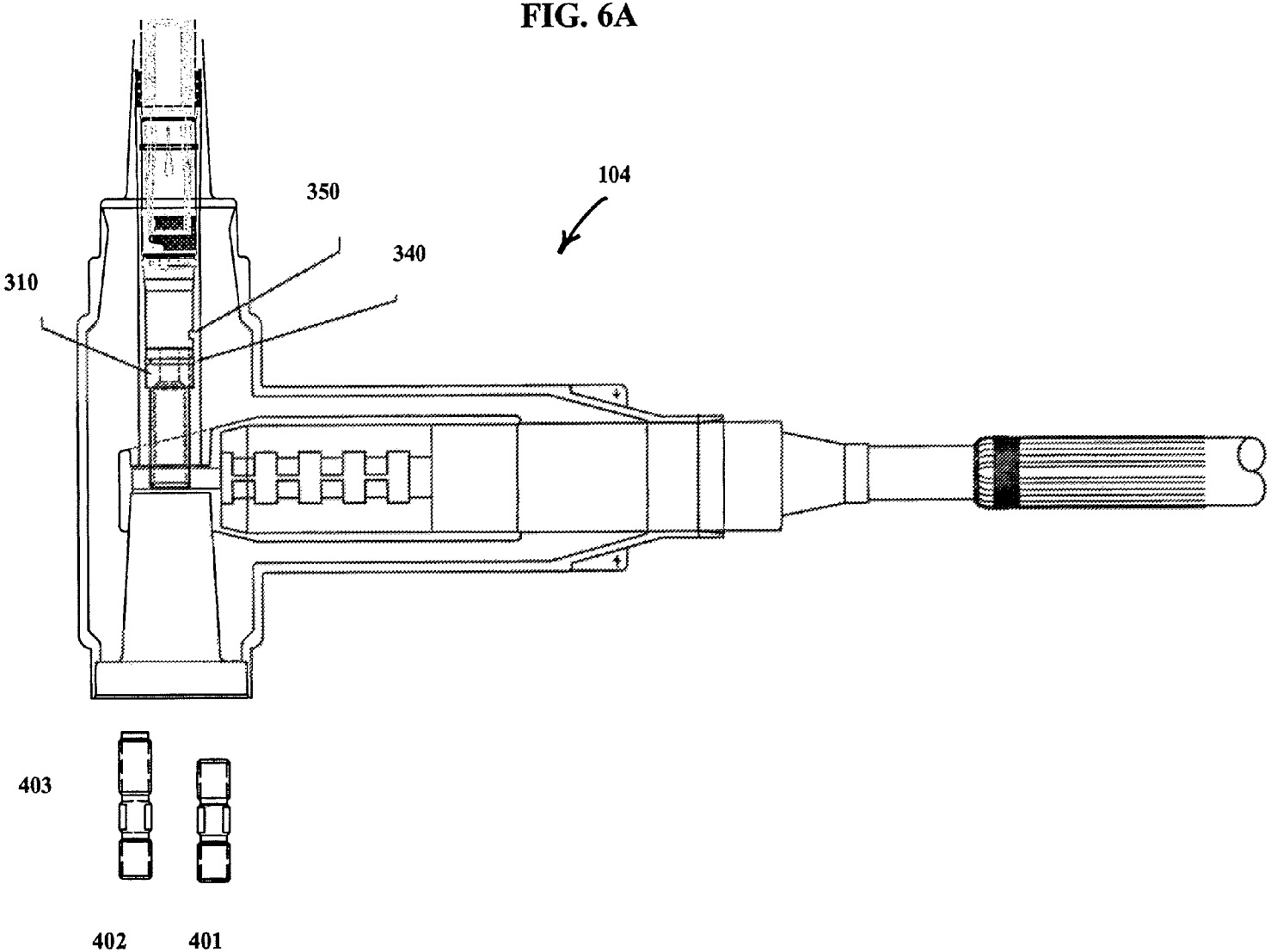
FIG. 6A is a cross-sectional view of an elbow housing incorporating a termination system in accordance with an embodiment of the present invention.
Figure 6B:
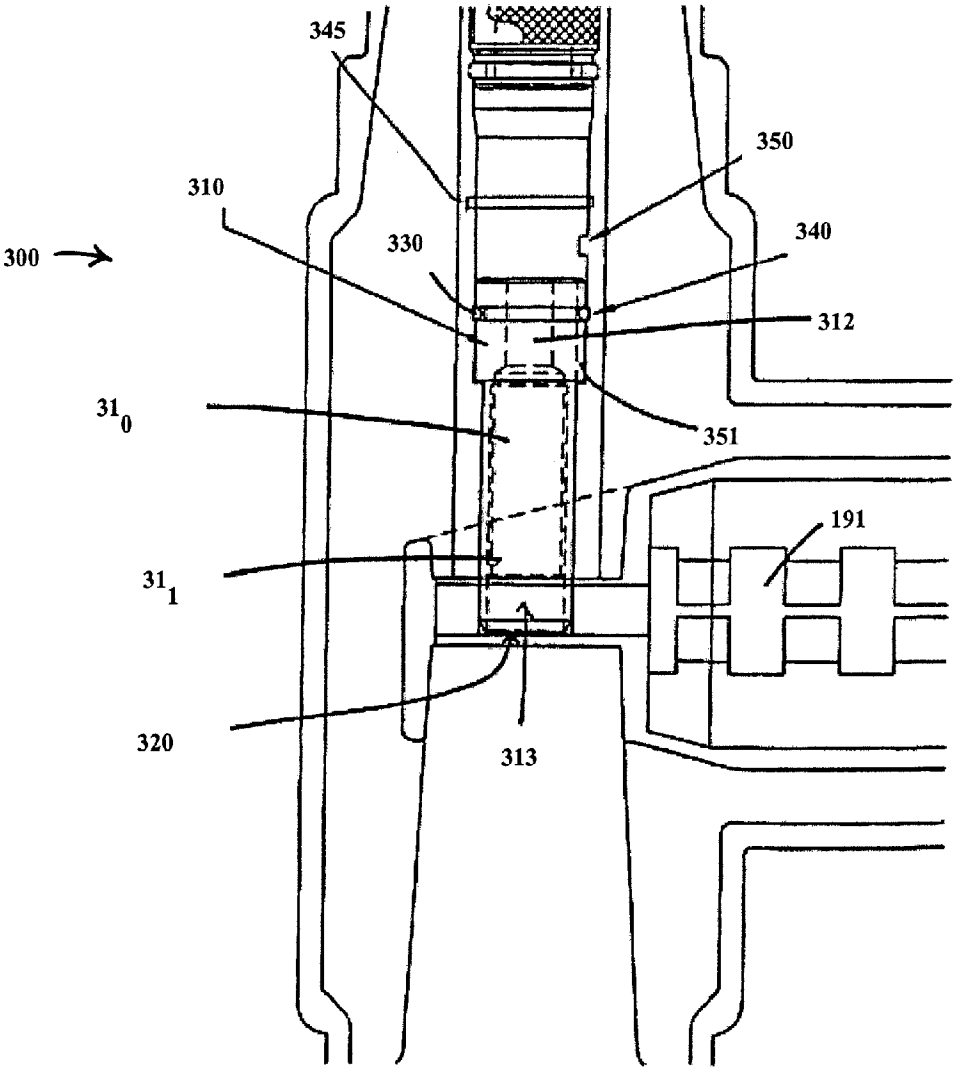
FIG. 6B is a magnified view of area D of FIG. 6A.

As shown in FIGS. 5B and 6B, component portion 300 can comprise an anti-rotation element 350 to prevent fastener 310 from rotating when in the retracted position. For example, a pin 350 preferably engages a groove 351 preferably located in the rotating portion 312 of fastener 310. Fastener 310 can be displaced a sufficient distance until pin 350 exits groove 351, thereby permitting fastener 310 to rotate. Anti-rotation element 350 preferably prevents a faulty installation that may be caused by the stud of the bushing entering aperture 192 of lug 191 and engaging female threaded section 311 of fastener 310 prior to female threaded section 311 being inserted into aperture 192. Therefore, the stud of the bushing cannot threadingly engage female threaded section 311 while female threaded section 311 is in the retracted position, with leading edge 320 jamming into the face of lug 191 rather than passing through aperture 192 of lug 191.

In accordance with an embodiment of the invention, fastener 310 can comprise one or more beveled edges, which preferably provides a good lead in of fastener 310 into aperture 192. The beveled edges can preferably substantially prevent fastener 310 from getting stuck or jammed.

When fastener 310 is pushed by the hex tool, it is preferred for a leading edge 320 to be pushed into aperture 192 of lug 191. As shown in FIGS. 6A and 6B, fastener 310 is pushed through aperture 192 until leading edge 320 stops proximate the opposite end of aperture 192.

Fastener 310 according to an embodiment of the invention preferably also comprises a locking element, which can retain fastener 310 in the extended position. For example, a snap ring 330 can move into a groove 340, thereby preventing fastener 310 from moving. In accordance with a preferred embodiment of the invention, the locking element can also maintain fastener 310 in the retracted position prior to initiation of fastener 310 into the extended position. Referring to FIG. 5B, snap ring 330 can extend into a groove 345 when fastener 310 is in the retracted position.

Once fastener 310 is locked in the extended position, elbow assembly 302 can be placed on a bushing having a stud, via second bore 121 until the stud engages female threaded section 311. The male mating portion preferably cannot be inserted into the aperture of female threaded section 311 unless they threadingly engage each other. Preferably, by using a rotating tool, such as a hex tool, the installer can rotate fastener 310 and threadingly engage female threaded section 311 of fastener 310 with the male mating portion of the bushing. According to a preferred embodiment of the invention, rotating fastener 310 pulls the stud further toward component portion 300, hence tightening elbow assembly 104 onto the terminal of the apparatus.

In accordance with an embodiment of the invention, female threaded section 311 comprises aperture 313 suitable for receiving a variety of lengths of the male mating portion of the bushing. For example, male mating portions known in the art include symmetrical studs 401 and an extended stud 402 having an extended threaded end 403.

Figure 7:
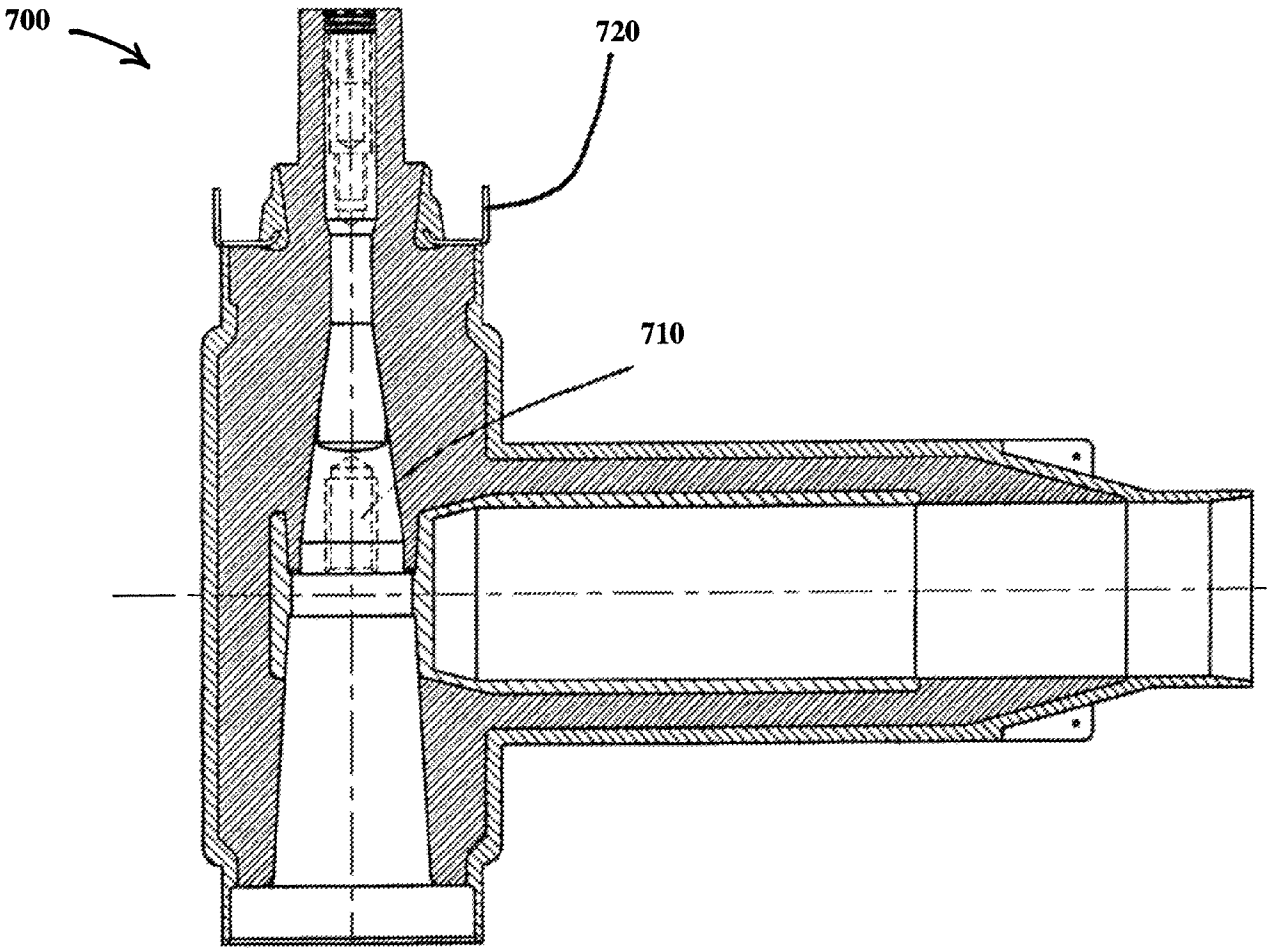
FIG. 7 is a cross-sectional view of an elbow housing incorporating a termination system in accordance with an embodiment of the present invention.
Figure 8:
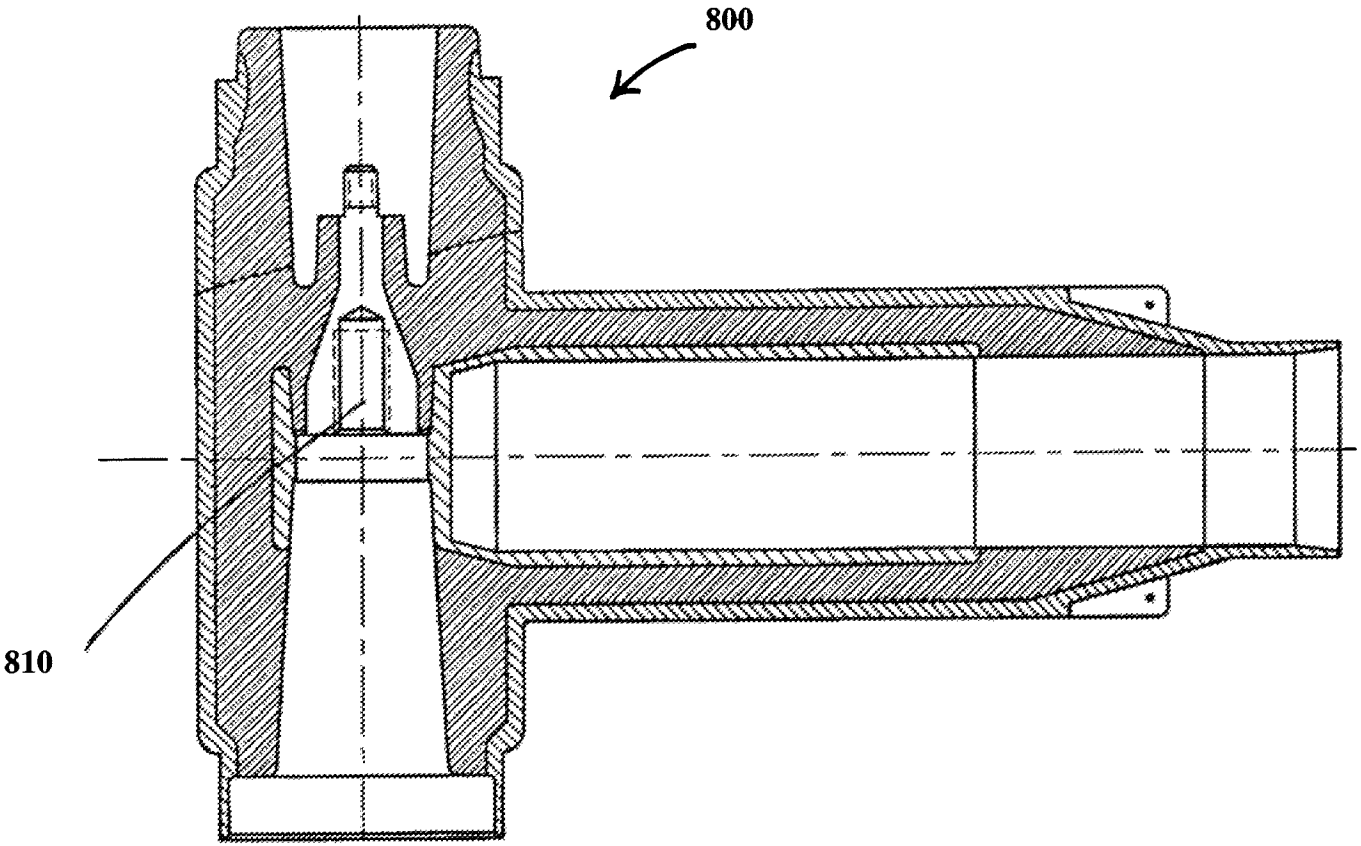
FIG. 8 is a cross-sectional view of an elbow housing incorporating a termination system in accordance with an embodiment of the present invention.
Figure 9:
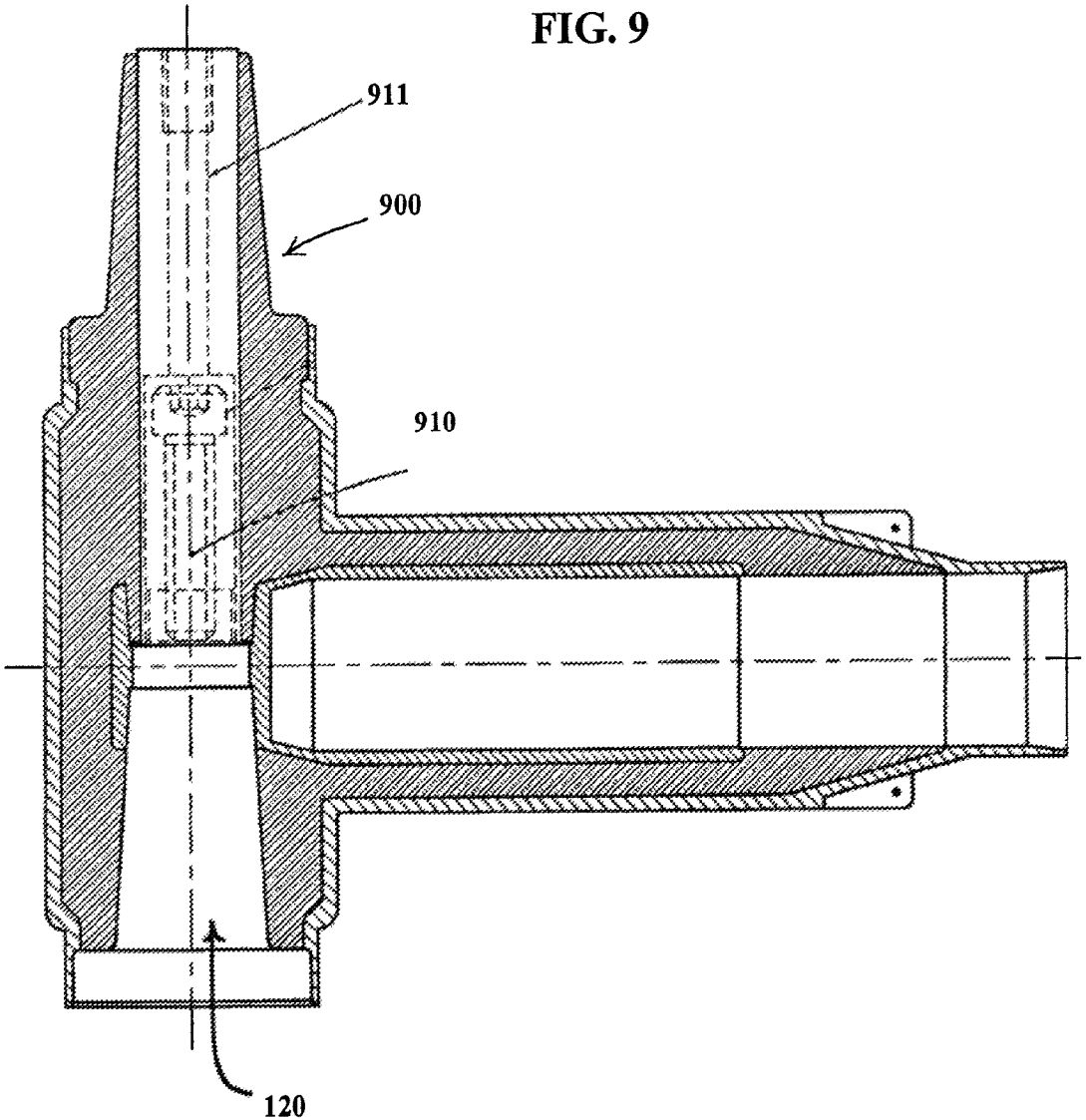
FIG. 9 is a cross-sectional view of an elbow housing incorporating a termination system in accordance with an embodiment of the present invention.

The invention can be constructed to comprise a variety of component portions. For example, FIGS. 3A-6B depict embodiments of the invention comprising at least some features of an integrally molded loadbreak reducing tap, FIG. 7 depicts an embodiment of the invention comprising at least some features of an integrally molded reducing tap plug, FIG. 8 depicts an embodiment of the invention comprising at least some features of an integrally molded reducing tap well, and FIG. 9 depicts an embodiment of the invention comprising at least some features of an integrally molded connecting plug. Preferably, the appropriate contact is also incorporated within the housing. Referring specifically at least to a 35 kV rated connecting plug, which comprises rubber because of potential electrical problems, termination systems comprising a separate component can be difficult to assemble. The present invention eliminates the need for assembling the various parts by molding them integrally within.

It is to be understood that stud 910 can be positioned at the opposite side of the component portion, proximate area 911, and a cavity where stud 910 is illustrated in FIG. 9, or both ends of the component portion can comprise cavities or studs without deviating from the scope of the invention as a matter of application specific to design choice. Preferably, a plurality of termination systems having a component portion comprising features of a connection plug can be connected to one another in series.

Another benefit that can be provided by the embodiments of the invention discussed herein is reduced stack height compared to the prior art devices. This benefit can result from the elimination of the redundant interfaces of a housing and a separately molded component. According to the prior art termination systems, both the housing and the separately molded component include an interface for engaging the corresponding element. The embodiments of the invention described herein substantially eliminates the need for such interfaces because the component is integrally formed into the housing. Therefore, because the interfaces are eliminated, the resulting stack height can be shorter than that of the prior art termination systems.

Figure 10:
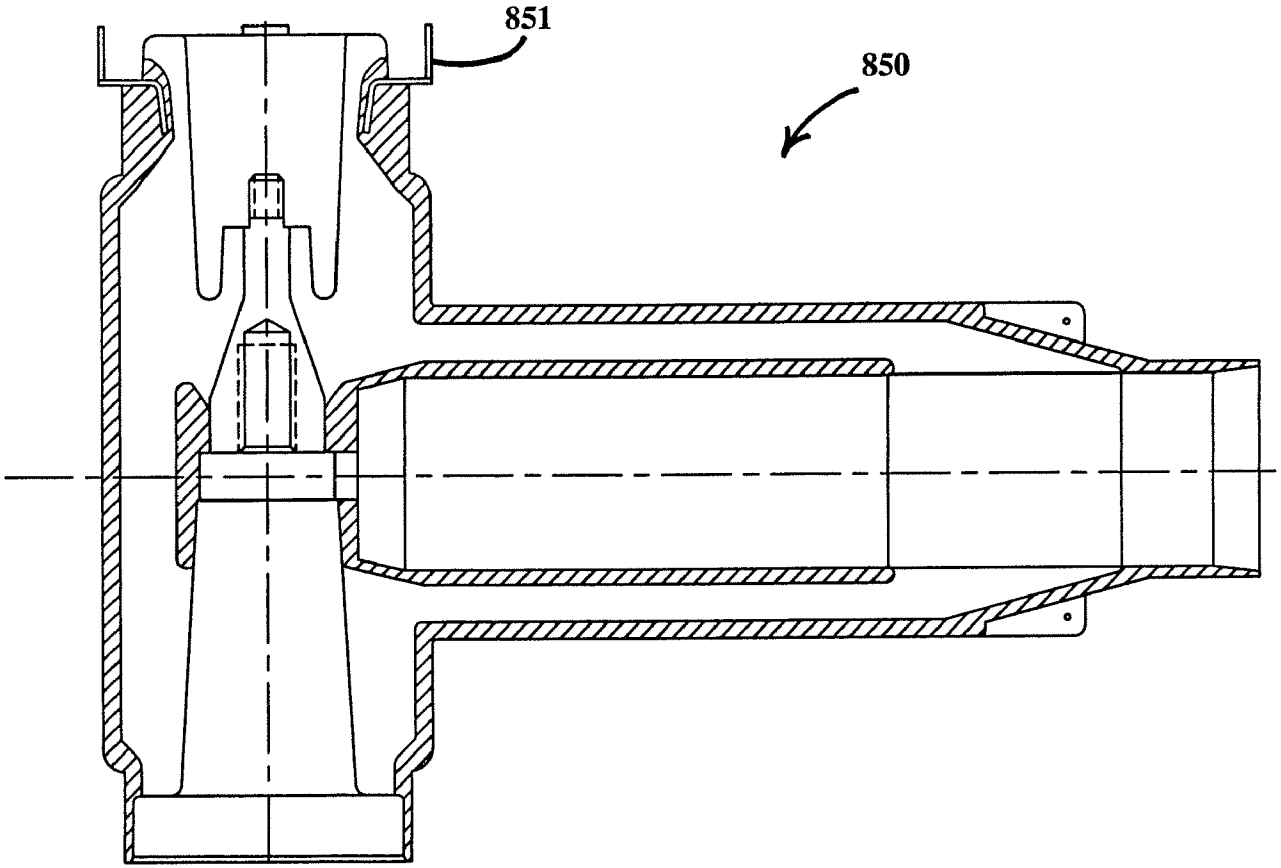
FIG. 10 is a cross-sectional view of an elbow housing incorporating a termination system in accordance with an embodiment of the present invention.
Figure 11:
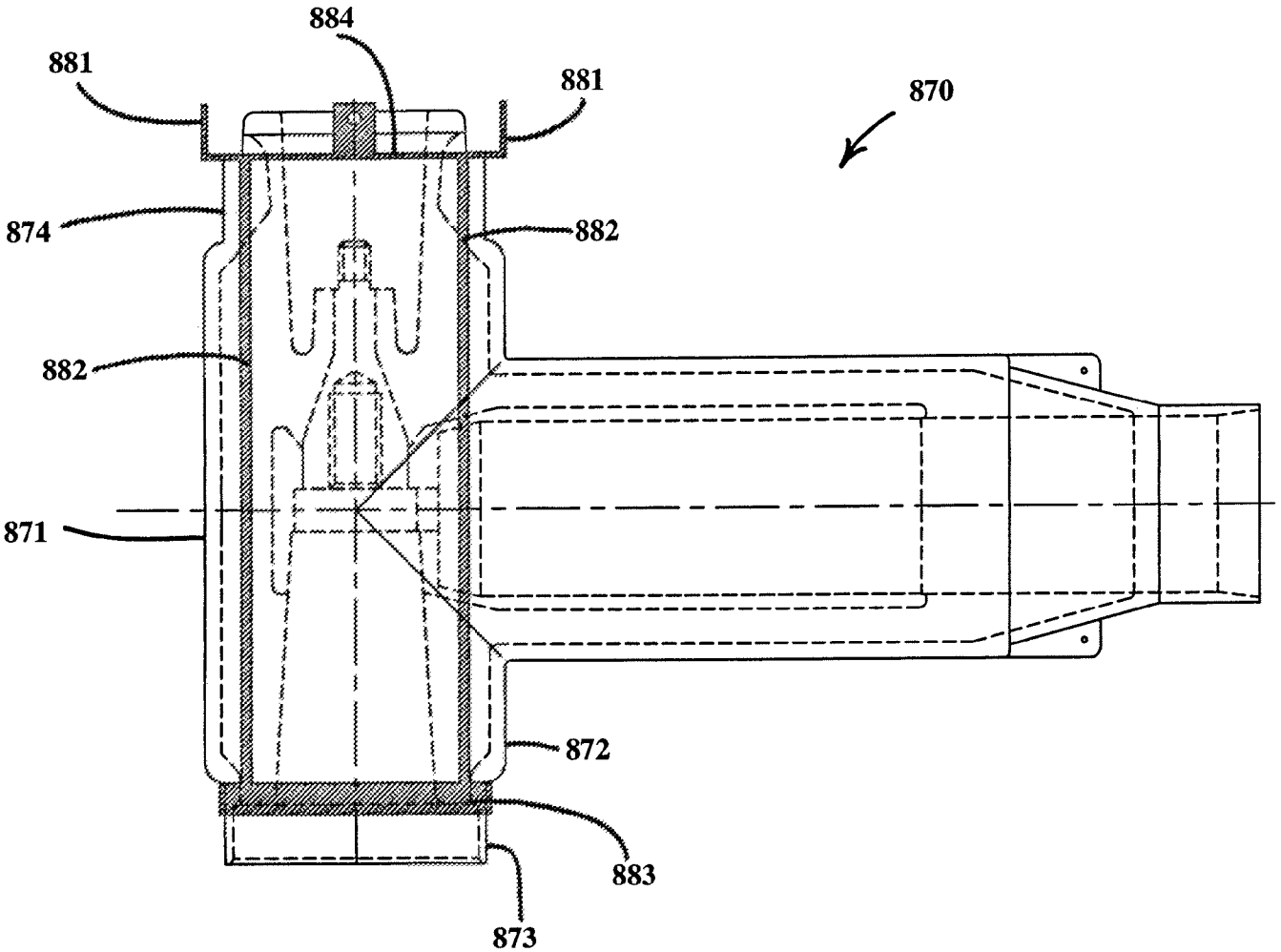
FIG. 11 is a cross-sectional view of an elbow housing incorporating a termination system in accordance with an embodiment of the present invention comprising a flange strapped thereon.

As shown in FIGS. 10-11, alternate embodiments of the invention can comprise flanges 851, 881 suitable for use with deadbreak inserts. Flanges 851, 881 preferably engage corresponding parts of the deadbreak inserts, preferably enhancing the connection of the two components. As shown in FIG. 10, according to one embodiment of the invention, flanges 851 can be molded into elbow 850. Alternatively, as shown in FIG. 11, according to an alternate embodiment, an external flange assembly 880 can be utilized.

According to an embodiment of flange assembly 880, as shown in FIG. 11, flange assembly 880 can comprise flanges 881, a flange base 884, straps 882 and retaining member 883. Retaining member 883 is preferably positioned in order to maintain flanges 881 in position and preferably prevents flanges 881 from shifting. For example, according to the example shown in FIG. 11, retaining member 883 is positioned around a narrow portion 873 of terminal receiving leg 871. Preferably, terminal receiving leg 871 comprises a first thicker portion 872 which prevents retaining member 883 from moving toward flange 881 beyond the point of contact between retaining member 883 and first thicker portion 872. Similarly, it is preferable for flange assembly 880 to comprise flange base 884 to engage flange stopping portion 874 of terminal receiving leg 871 that can prevent flanges 881 from moving toward retaining member 883 beyond the point of contact between flange base 884 and flange stopping portion 874. As shown in FIG. 11, flange assembly 880 can comprise straps 882 connecting flange base 884 and retaining member 883. Preferably, straps 882 substantially prevent flange base 884 and/or retaining member 883 from moving away from each other, thereby substantially eliminating the risk of flanges 881 from being moved or removed inadvertently.

One termination system in accordance with an embodiment of the invention can comprise a cold shrink termination system, for example, as described in U.S. Pat. No. 6,991,484, which is incorporated herein by reference in its entirety. The cable receiving leg can comprise two states, expanded and contracted, wherein a retaining element keeps the cable receiving leg in the expanded state. Preferably, a cable assembly can be inserted therein when the cable receiving leg is in the expanded state. Once the cable assembly is inserted, the retaining element is preferably removed, thereby releasing the cable receiving leg, whereupon the cable receiving leg preferably contracts around the cable assembly. Once the cable receiving leg is contracted around the cable assembly, it is in the contracted state, and preferably seals in the cable assembly to prevent the cable assembly from moving.

Figure 12:
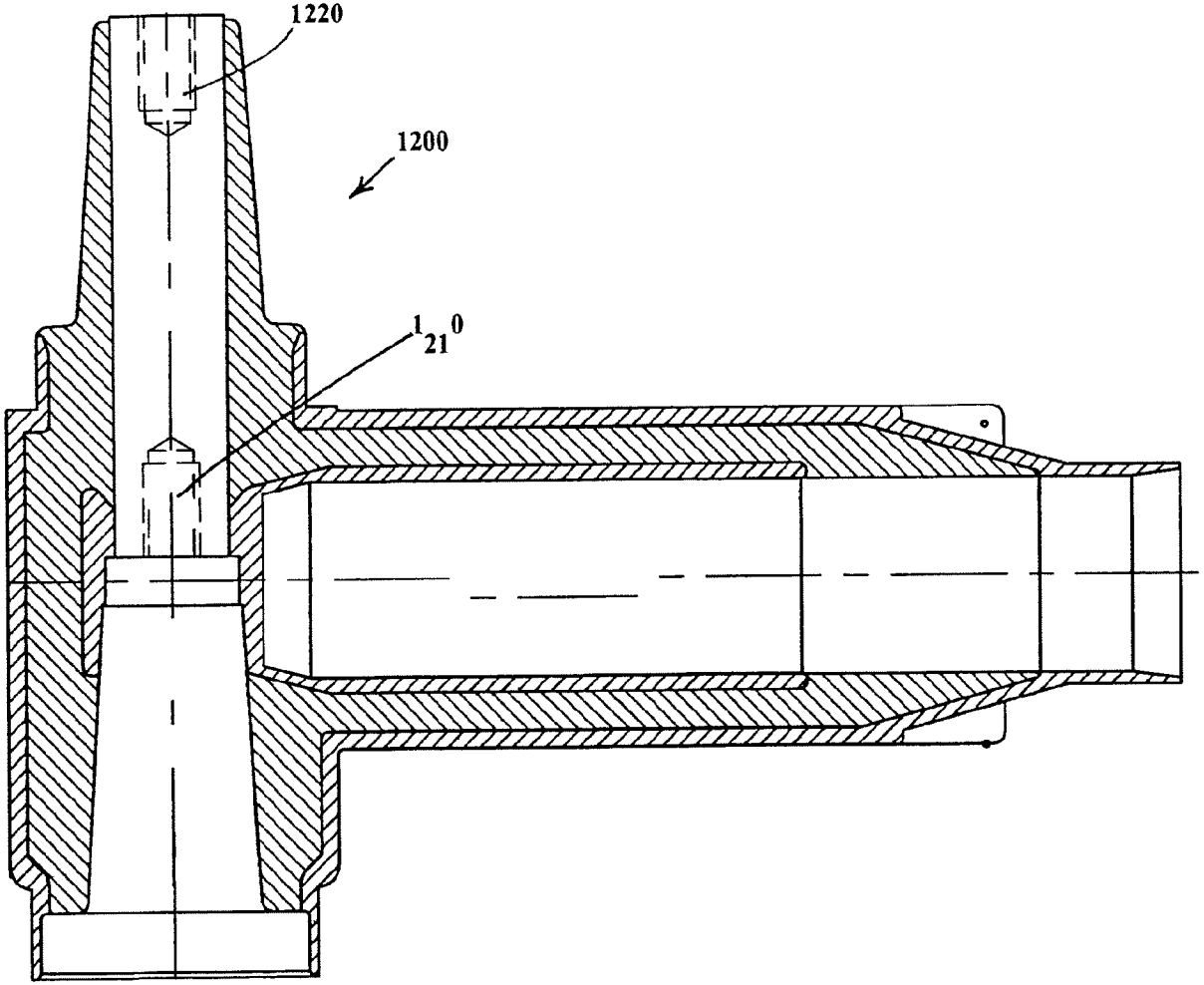
FIG. 12 is a cross-sectional view of an elbow housing incorporating a termination system in accordance with an embodiment of the present invention.
Figure 13:
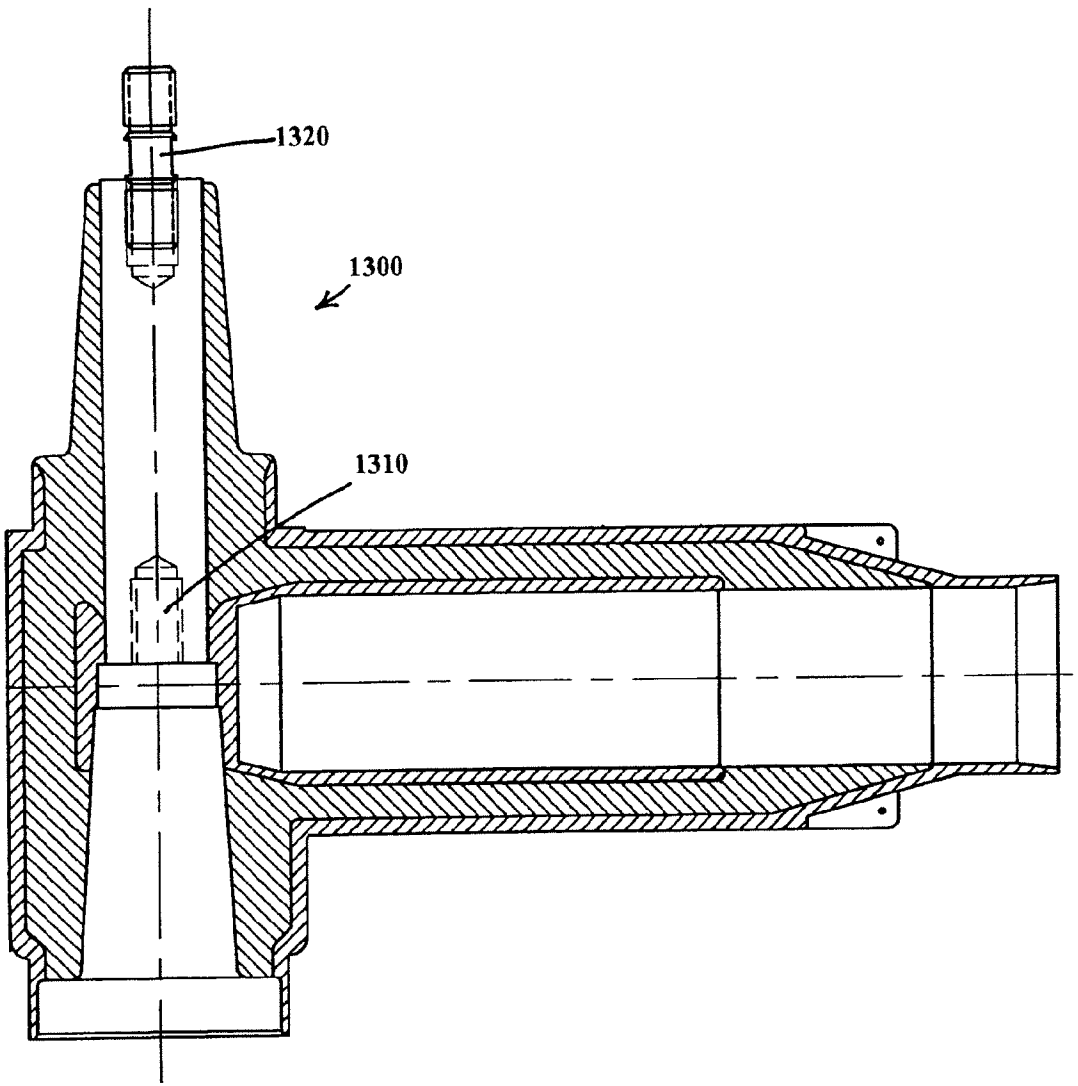
FIG. 13 is a cross-sectional view of an elbow housing incorporating a termination system in accordance with an embodiment of the present invention.
Figure 14:
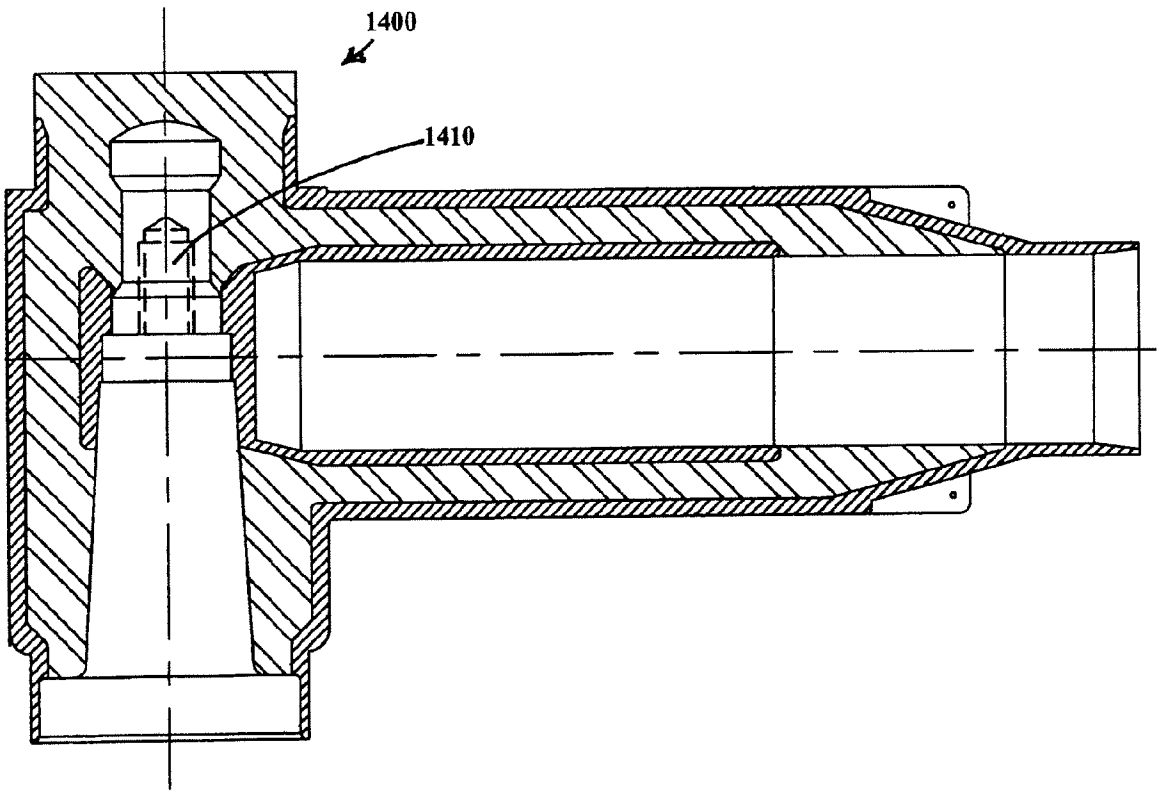
FIG. 14 is a cross-sectional view of an elbow housing incorporating a termination system in accordance with an embodiment of the present invention.
Figure 15:
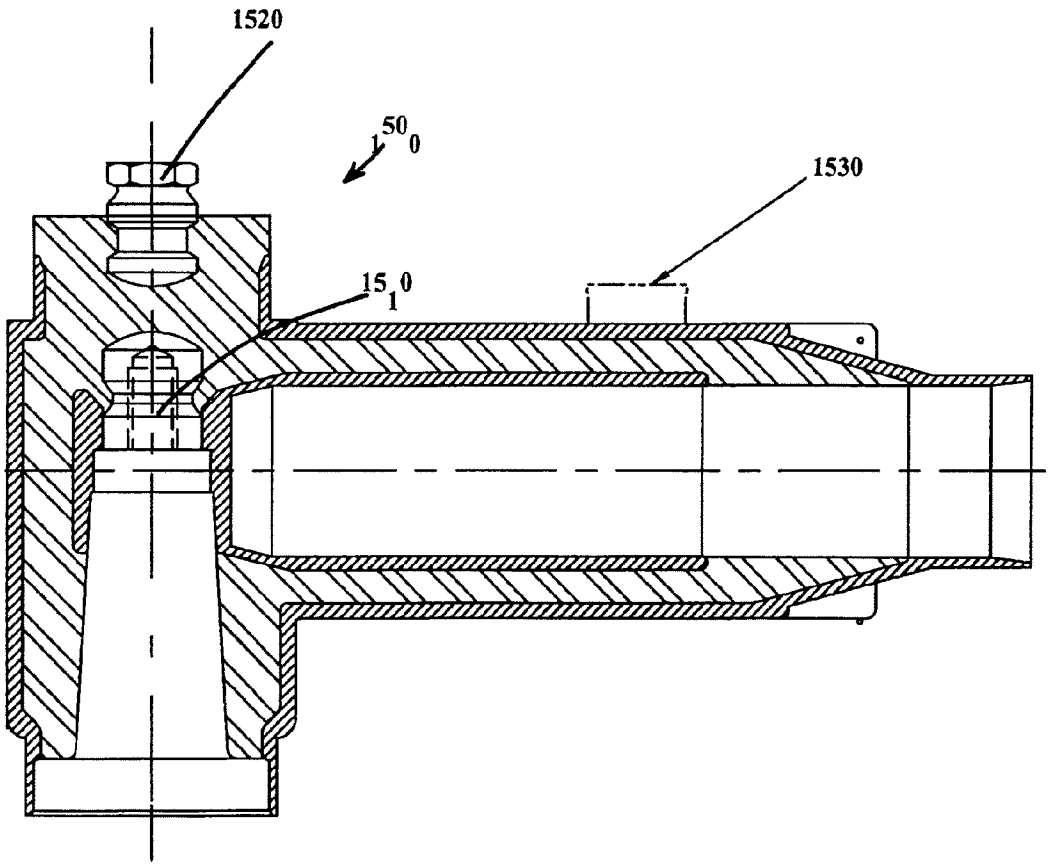
FIG. 15 is a cross-sectional view of an elbow housing incorporating a termination system in accordance with an embodiment of the present invention.
Figure 16:
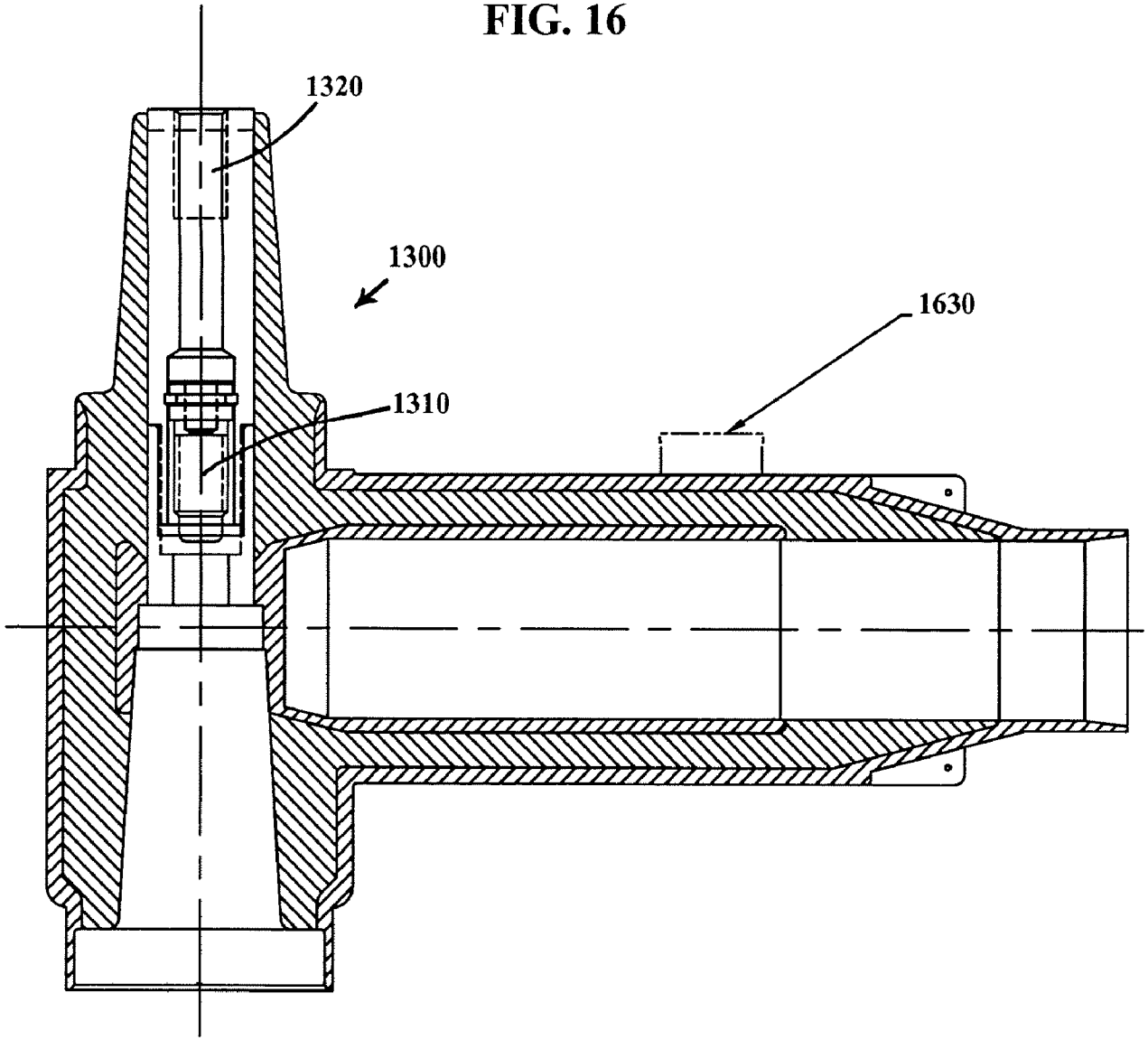
FIG. 16 is a cross-sectional view of an elbow housing incorporating a termination system in accordance with an embodiment of the present invention.

FIGS. 12-13 and 16 depict additional embodiments of the invention comprising at least some features of an integrally molded connecting plug having a component portion 1200, 1300, respectively. FIGS. 14-15 depict additional embodiments of the invention comprising at least some features of an integrally molded insulating plug having a component portion 1400, 1500, respectively. As shown in the embodiments depicted in FIGS. 7-8 and 12-15, component portion 700, 800, 1200, 1300, 1400, 1500 includes a stud receiving aperture 710, 810, 1210, 1310, 1410, 1510 suitable for receiving a male mating device. Preferably, a male mating device threadingly engages stud receiving aperture 710, 810, 1210, 1310, 1410, 1510.

According to the embodiment shown in FIG. 12, component portion 1200 can include a second stud receiving aperture 1220 on the opposite end of component portion 1200 from stud receiving aperture 1210. Therefore, the embodiment of FIG. 12 may be used to connect two devices having male mating portions. In contrast, FIG. 13 shows an embodiment wherein component portion 1300 includes a male mating portion 1320 on the opposite end of component portion 1300 from stud receiving aperture 1310.

Alternatively, as shown in FIG. 16, in accordance with an embodiment of the invention, component portion 1600 can include a rotatable captivated bolt 1610 and a stud receiving aperture 1620 on the opposite end of component portion 1600. Component portion 1600 can preferably mate with a fixed or stationary female mating device, such as a bushing in a switch, a transformer, a device similar to FIG. 12, etc. Captivated bolt 1610 is preferably rotated using an assembly tool, such as a hex tool, into the female mating device.

Referring to FIGS. 14-15, component portion 1400, 1500 can be provided either with or without a nut 1520, for example, a test point nut 1520 as shown, without deviating from the scope of the invention. One potential use of test point nut 1520 is as a test point for the device, such as an elbow, as depicted in FIG. 15. Other possible test points are illustrated in FIGS. 15-16 as test point 1530, 1630.

The examples provided are merely exemplary, as a matter of application specific to design choice, and should not be construed to limit the scope of the invention in any way. The invention can comprise integrally molded features of other components known or yet to be developed without deviating from the scope of the invention. For example, whereas FIG. 7 depicts a component portion 700 having flanges 720, it is to be understood that flanges 720 are optional and it would not deviate from the scope of the invention to exclude flanges 720 from a termination system in accordance with the invention. Additionally, whereas the embodiments are illustrated herein comprising a stud or a cavity, such studs can be substituted for cavities and vice versa without deviating from the scope of the invention. It is also to be understood that termination systems having components and the like presently known in the art directly molded therein are encompassed within the scope of the invention.

As described above, the present invention eliminates the need for a separate component, a separate bolt and extraneous portions such as a guide that detaches upon installation and a threaded portion for engaging the metallic lug. Accordingly, it provides for a safer, simpler, less expensive method of terminating cables to an apparatus. In addition, although the preferred embodiments of the termination system of the present invention are exemplified herein with reference to an elbow or T-shaped, housing, containing two perpendicular bores, it is understood that other housing configurations may be used with the present invention. For example, housings containing more than two bores and/or bores that are not perpendicular may be used. Other housing configurations include, but are not limited to, Y-shaped, L-shaped, and X-shaped housings. The Y-shaped housing is a good example of a housing containing three non-perpendicular bores.

While the present invention has been described with reference to one or more embodiments set forth in considerable detail for the purposes of making a complete disclosure of the invention, such embodiments are merely exemplary, and are not intended to limit or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

I claim:

1. A housing for terminating a cable to one or more devices, said housing comprising:

a cable assembly receiving bore for receiving a cable assembly having a lug thereon, said lug comprising a lug aperture therein;

a device receiving bore for receiving a device mating portion, said device mating portion comprising a female stud-receiving-aperture;

a component portion integrally formed within the housing, said component portion comprising a fastener comprising a male stud portion;

said fastener being displaceable between a retracted position wherein said male stud portion does not extend through said lug aperture and an extended position wherein said male stud portion extends through said lug aperture.

2. The housing of claim 1, wherein the device is a termination system, a transformer, a switch, a connector or a switchgear.

3. The housing of claim 1, wherein the component portion comprises the internal features of a reducing tap plug or a connecting plug.

4. The housing of claim 1, wherein the component portion comprises the internal features of a loadbreak reducing tap plug or a dead break reducing tap plug.

5. The housing of claim 1, wherein the male stud portion includes a threaded portion.

6. The housing of claim 1, wherein the fastener further comprises a retainer constructed and arranged to releasably maintain the fastener in at least one predetermined position.

7. The housing of claim 1, wherein the fastener is constructed and arranged to freely rotate independent from the movement of the housing when the stud is in a retracted position.

8. The housing of claim 1, comprising an anti-rotation element constructed and arranged to prevent rotation of the stud when the stud is in the retracted position.

9. The housing of claim 1, further comprising one or more flanges constructed and arranged to engage a bail arrangement for an assembly, the assembly comprising an elbow and a deadbreak insert.

10. The housing of claim 1, wherein the housing comprises a 600 ampere elbow.

11. The housing of claim 1, wherein the cable assembly receiving bore has an expanded state and a contracted state, wherein the cable assembly can be inserted into the cable assembly receiving bore when the cable assembly receiving bore is in the expanded state, and wherein the cable assembly receiving bore contracts around the cable assembly when in the contracted state.

12. A housing for terminating a cable to one or more devices, said housing comprising:

a cable assembly receiving bore for receiving a cable assembly having a lug thereon, said lug comprising a lug aperture therein;

a device receiving bore for receiving a device mating portion, said device mating portion comprising a male stud portion;

a component portion integrally formed within the housing, said component portion comprising a fastener comprising a female stud-receiving-aperture;

said fastener being displaceable between a retracted position wherein said fastener does not extend into said lug aperture and an extended position wherein said fastener extends into said lug aperture.

13. The housing of claim 12, wherein the female stud receiving aperture comprises an internal threaded portion.

14. The housing of claim 12, wherein one device comprises a connecting plug or an elbow.

15. The housing of claim 12, wherein the fastener is retractable.

16. The housing of claim 12, wherein the fastener is fixed.

17. The housing of claim 12, wherein the component portion comprises the internal features of a reducing tap well, an insulating plug, a connecting plug, or a loadbreak reducing tap plug.

18. The housing of claim 1, wherein the fastener is retractable.

19. The housing of claim 1, wherein the fastener is fixed.

20. A housing for terminating a cable to one or more devices, said housing comprising:

a cable assembly receiving bore for receiving a cable assembly having a lug thereon, said lug comprising a lug aperture therein;

a device receiving bore for receiving a device mating portion, said device mating portion comprising a male stud portion;

a component portion integrally formed within the housing, said component portion comprising a fastener comprising a female stud-receiving-aperture for receiving the male stud portion of the device mating portion.

21. The housing of claim 20, wherein the component portion comprises the internal features of a reducing tap well or a reducing tap plug.

22. The housing of claim 20, wherein the component portion comprises the internal features of a load reducing tap plug.

* * * * *